US009199144B2

(12) United States Patent
Mendoza et al.

(10) Patent No.: US 9,199,144 B2
(45) Date of Patent: Dec. 1, 2015

(54) MULTI-PIECE IRON GOLF CLUB HEAD

(71) Applicant: Acushnet Company, Fairhaven, MA (US)

(72) Inventors: Eduardo Mendoza, Keller, TX (US); Jonathan A. Hebreo, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/209,800

(22) Filed: Mar. 13, 2014

(65) Prior Publication Data

US 2015/0258396 A1 Sep. 17, 2015

(51) Int. Cl.
*A63B 53/04* (2015.01)

(52) U.S. Cl.
CPC ..... *A63B 53/0475* (2013.01); *A63B 53/047* (2013.01); *A63B 2053/0408* (2013.01)

(58) Field of Classification Search
CPC ..... A63B 53/047; A63B 2053/04; A63B 2053/0408
USPC ..... 473/350, 349, 348
See application file for complete search history.

(56) References Cited

U.S. PATENT DOCUMENTS

| | | | | |
|---|---|---|---|---|
| 4,420,156 | A | 12/1983 | Campau | |
| 4,928,972 | A | 5/1990 | Nakanishi et al. | |
| 4,930,781 | A | 6/1990 | Allen | |
| 4,964,640 | A | 10/1990 | Nakanishi et al. | |
| 4,992,236 | A | 2/1991 | Shira | |
| 5,024,437 | A | 6/1991 | Anderson | |
| 5,154,781 | A | 10/1992 | Catellier | |
| 5,205,560 | A | 4/1993 | Hoshi et al. | |
| 5,263,717 | A | 11/1993 | McCallister | |
| 5,395,113 | A | 3/1995 | Antonious | |
| 5,429,353 | A | 7/1995 | Hoeflich | |
| 5,509,660 | A | 4/1996 | Elmer | |
| 5,603,667 | A | 2/1997 | Ezaki et al. | |
| 5,716,288 | A | 2/1998 | Sacco | |
| 5,766,092 | A | 6/1998 | Mimeur et al. | |
| 5,833,551 | A | 11/1998 | Vincent et al. | |
| 5,841,046 | A | 11/1998 | Rhodes et al. | |
| 5,935,018 | A | 8/1999 | Takeda | |
| 5,967,903 | A | 10/1999 | Cheng | |
| 6,045,456 | A | 4/2000 | Best et al. | |
| 6,200,228 | B1 | 3/2001 | Takeda | |
| 6,554,722 | B2 | 4/2003 | Erickson et al. | |
| 6,638,183 | B2 | 10/2003 | Takeda | |
| 6,713,717 | B2 | 3/2004 | Takeda | |
| 6,743,120 | B1 * | 6/2004 | Chen | 473/349 |
| 6,777,640 | B2 | 8/2004 | Takeda | |
| 7,153,222 | B2 | 12/2006 | Gilbert et al. | |
| 7,654,914 | B2 | 2/2010 | Roach et al. | |
| 7,867,105 | B2 | 1/2011 | Moon | |
| 8,282,506 | B1 | 10/2012 | Holt | |
| 2001/0055996 | A1 * | 12/2001 | Iwata et al. | 473/350 |

(Continued)

OTHER PUBLICATIONS

Mizuno Catalogue, Golf Collection, 2003, cover and pp. 2-6.

(Continued)

*Primary Examiner* — Benjamin Layno
(74) *Attorney, Agent, or Firm* — Randy K. Chang

(57) ABSTRACT

A multi-piece iron golf club head is disclosed herein. More specifically, the present invention utilizes multi-piece construction to incorporate geometric features such as an undercut into a golf club head that is forged.

15 Claims, 5 Drawing Sheets

(56) References Cited

U.S. PATENT DOCUMENTS

| | | | | |
|---|---|---|---|---|
| 2003/0176231 | A1* | 9/2003 | Hasebe | 473/291 |
| 2006/0135285 | A1* | 6/2006 | Hou et al. | 473/342 |
| 2006/0194645 | A1* | 8/2006 | Sugimoto | 473/342 |
| 2006/0258480 | A1 | 11/2006 | Hou et al. | |
| 2012/0252601 | A1* | 10/2012 | Thomas | 473/345 |
| 2013/0196785 | A1* | 8/2013 | Takechi | 473/332 |

OTHER PUBLICATIONS

Hogan Catalogue, 1992, cover and p. 4.
www.kensmithgolf.com/irons.htm, The Imperial Collection, DB.SS Irons, Nov. 5, 2002, pp. 1-7.

* cited by examiner

MULTI-PIECE IRON GOLF CLUB HEAD

FIELD OF THE INVENTION

The present invention relates generally to a multi-piece iron golf club head. More specifically, the present invention relates to a multi-piece iron golf club head construction wherein one or more forged pieces of steel can be combined and joined together to create unique geometries traditionally reserved for casting type construction methods. These unique geometries allows the present invention to take advantage of the performance benefits of a forged golf club all while incorporating geometries traditionally unachievable by the a pure one piece forging construction.

BACKGROUND OF THE INVENTION

The design of an iron type golf club head has been on a constant and steady improvement curve ever since the early days of golf. Today's iron type golf club head are not only capable of hitting the golf ball longer, straighter, but are also capable of doing that more consistently.

Golf club designers, in order to achieve the current technological improvement, have manipulated with the center of gravity location, moment of inertia, as well as numerous other factors of the iron type golf club head via innovative design changes that depart from what a conventional iron type golf club head looks like. These design changes include the usage of unique constructions, usage of multiple materials, and even the usage of advanced manufacturing methods. In one example shown in U.S. Pat. No. 8,282,506 to Holt, the inventor attempted increase the moment of inertia of a golf club head to create more discretionary weight by creating a golf club head with a rear cavity with an undercut. In another example, U.S. Pat. No. 6,554,722 to Erickson et al. illustrates the usage of multiple materials by teaching bi-material weight having a nonhomogeneous structure to be used in a golf club head. Finally, U.S. Pat. No. 5,766,092 to Mimeur et al. illustrates a method of construction used to improve the performance of an iron type golf club head.

However, as these technological advancements in iron golf club head performance develop, some golfers began to notice that there is more to a golf club than absolute performance. In fact, for majority golfers, the intangibles of a golf club such as the aesthetic appeal, the sound it produces, and the feel that it generates can often be even more important than the performance of the golf club head itself.

One of the key features that affect the sound and feel of a golf club head is the method from which the clubhead is made. Golfers, especially better golfers, prefer the sound and feel of a forged golf club head over that of a cast golf club head. The rationale for preferring a forged golf club head is because it is formed from a solitary piece of steel, without melting down and reforming the structure of the material itself. The drawback of forging a golf club head from a unitary piece of metal is that it is limited in shape and geometry by the inherent forging process; prohibiting extreme geometries from being used.

Based on the preference of golfers for a forged golf club head, combined with the inherent geometric limitations associated with the forging process, it can be seen that there exists a need for a golf club head to be manufactured using the forging process to maintain the improved feel all while still utilizing advanced geometric shapes to improve performance. More specifically, there is a need in the field for a golf club head that maintains the preferred look, sound, and feel of a forged golf club head while exploring advance geometric configurations that were traditionally reserved for a cast golf club head.

BRIEF SUMMARY OF THE INVENTION

In one aspect of the present invention is an iron type golf club head comprising of a forged frontal portion having a first cavity and a substantially planar frontal flange and a back portion having a second cavity and a substantially planar back flange; wherein the frontal portion and the back portion are joined together at an interface between the frontal flange and the back flange portions to form the iron type golf club head, and wherein the golf club head comprises an undercut around the joint of the frontal portion and the back portion.

In another aspect of the present invention is an iron type golf club head comprising of a forged frontal portion having a first cavity and a substantially planar frontal flange and a back portion having a second cavity and a substantially planar back flange, wherein the frontal portion and the back portion are joined together at an interface between the frontal flange and the back flange portions to form the iron type golf club head, and wherein the forged frontal portion has a mass of between about 115 grams to about 125 grams, and wherein said back portion has a mass of between about 70 grams to about 90 grams. Finally, the forged frontal portion and the back portion combine to create an undercut in the golf club head cavity portion.

In a further aspect of the present invention is an iron type golf club head comprising of a forged frontal portion having a first cavity and a substantially planar frontal flange and a back portion having a second cavity and a substantially planar back flange, wherein the frontal portion and the back portion are joined together at an interface between the frontal flange and the back flange portions to form the iron type golf club head. The forged frontal portion and the back portion combine to create an undercut, and wherein the planar frontal flange and the planar combine to yield an Undercut Surface Area Ratio of greater than 1; the Undercut Surface Area Ratio is defined as an area of the back flange divided by an area of the frontal flange.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
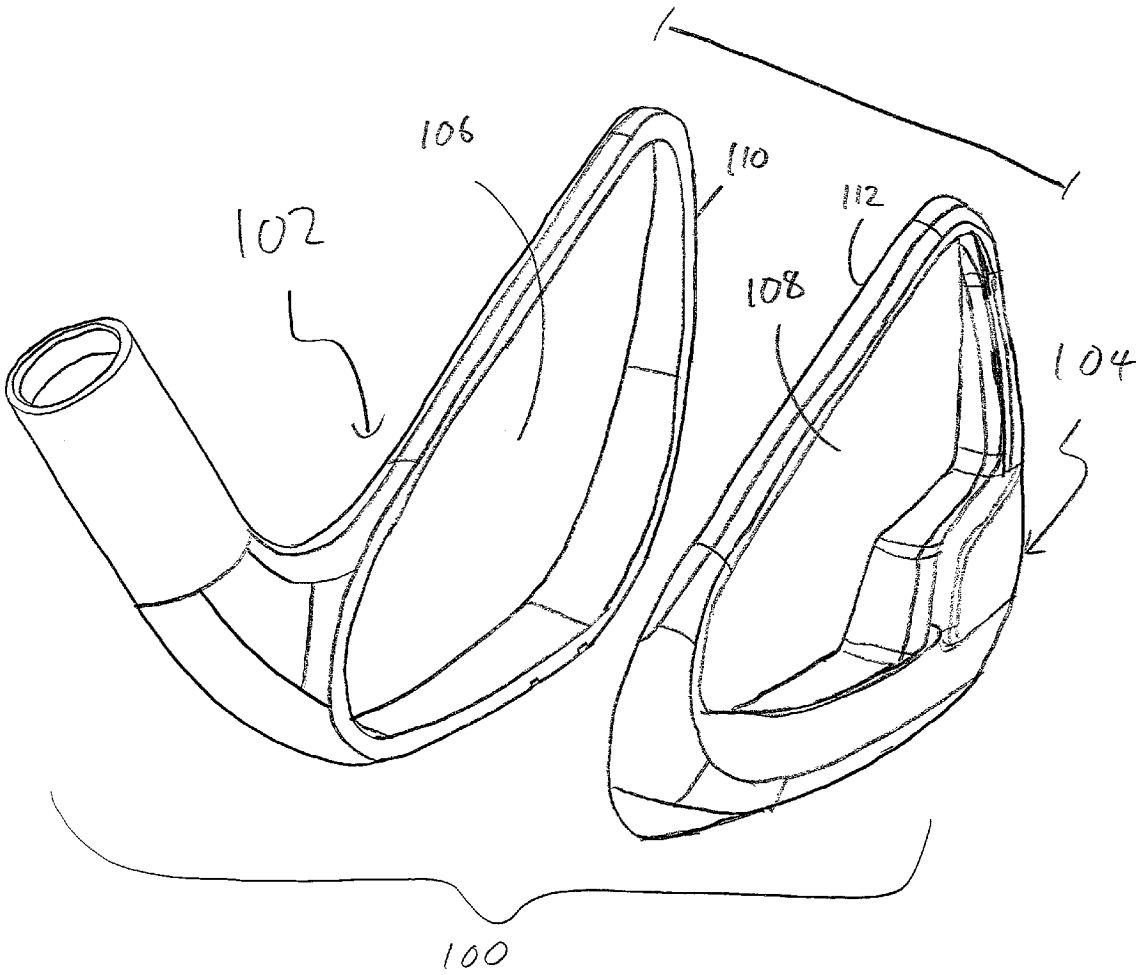
FIG. 1 of the accompanying drawings show an exploded perspective view of a golf club head in accordance with an embodiment of the present invention.

FIG. 1 of the accompanying drawings shows an exploded perspective view of a golf club head 100 in accordance with an exemplary embodiment of the present invention. More specifically, the golf club head 100 may further comprise of a forged frontal portion 102 and a forged back portion 104. Before moving on into the discussion regarding the details of each of the individual forged portions, it is worthwhile to emphasize that each of these components are forged from a solid piece of steel. It is very important to recognize that these individual pieces of the golf club head are forged because the ingenuity of the present invention is strongly tied to the forged nature of these individual pieces. The current multi-piece iron construction allows at least one forged portion of a golf club head to combine with another portion of the golf club head to create geometries such as an undercut that were unachievable in a conventional one piece forging.

Forging process is a manufacturing process that involves the shaping of metal using a localized compressive forces stemming from a die. The metal material, as a response to the compressive forces, deforms into the desired geometry. It is often said that the forging process can produce a product that is stronger and have a better feel than the equivalent cast or machined part, as the metal's internal grain deforms in alignment with the shape of the metal during the forging process. Moreover, because the forging process utilizes a unitary piece of metal, the grain structure is continuous throughout the part, giving rise to the improvements described above.

The usage of the forging process to create a golf club head has been known, and more information regarding the forging of a golf club head can be found in U.S. Pat. No. 7,153,222 to Gilbert et al., the disclosure of which is incorporated by reference in its entirety. However, the limitations of forging a golf club head is also well know, as the inherent process prohibits the creation of any negative draft angles and any undercuts.

One of the key benefits of having a golf club head with an undercut is the increase the moment of inertia of a golf club head because it removes weight from unnecessary portions of the golf club head. The removal of weight from unnecessary portions of the golf club head helps move more mass further back in the club head to increase its ability to resist twisting when contacting a golf ball off center. In addition to increasing the moment of inertia, the removal of the unnecessary weight in the creation of the undercut also helps improve the center of gravity properties of the golf club head by creating more discretionary weight.

In order to address the geometric limitations of the forging process, golf club designers have had to resort to a casting process or post manufacturing machining process to create the desired geometry, sacrificing the strength, sound, and feel properties of the golf club head. The method of casting, although capable of creating extreme geometric shapes through the usage of inserts in the mold, suffers from the aforementioned drawback in the strength, sound, and feel department.

The current invention, in an attempt to capture the strength, sound, and feel benefits of a golf club in a forged golf club head together with the geometries traditionally reserved for a cast golf club head, have create two independently forged portions. The frontal portion 102 in this embodiment may generally include the striking face, the hosel, and a portion of the topline, a portion of the heel, a portion of the toe, and a portion of the sole. The back portion 104, on the other hand, includes the muscle portion, a portion of the topline, a portion of the heel, a portion of the toe, and a portion of the sole. The frontal portion contains a first cavity 106 that opens towards the back of the golf club head 100 with a frontal flange 110 surrounding the first cavity 106. The back portion 104 contains a second cavity 108 that opens towards the front of the golf club head 100 with a back flange 112 surrounding the second cavity 108. The current invention incorporates opposing cavity opening orientations to bisect the golf club head 100 allowing geometries such as an undercut to be created while still utilizing the forged manufacturing process.

In the current embodiment, the frontal portion 102 may generally have a mass of between about 110 grams to about 130 grams, more preferably between about 115 grams to about 125 grams, and most preferably about 120 grams. The back portion 104, on the other hand, may have a mass of between about 70 grams to about 90 grams, more preferably between about 75 grams to about 85 grams, and most preferably about 80 grams. All of the masses above assume that the current golf club head 100 is made out of a steel material with a density of between about 7.75 grams/$cm^3$ and 8.05 grams/$cm^3$.

Based on the weight distribution described above, the present golf club head 100 may have a Weight Distribution Ratio of between about 1.20 and about 1.85, more preferably between about 1.45 and about 1.55, most preferably about 1.5; the Weight Distribution Ratio is defined as a mass of the frontal portion 102 divided by a mass of the back portion 104 as illustrated in Equation (1) below:

$$\text{Weight Distribution Ratio} = \frac{\text{Mass of frontal portion 102}}{\text{Mass of back portion 104}} \qquad \text{Eq. (1)}$$

Figure 2:
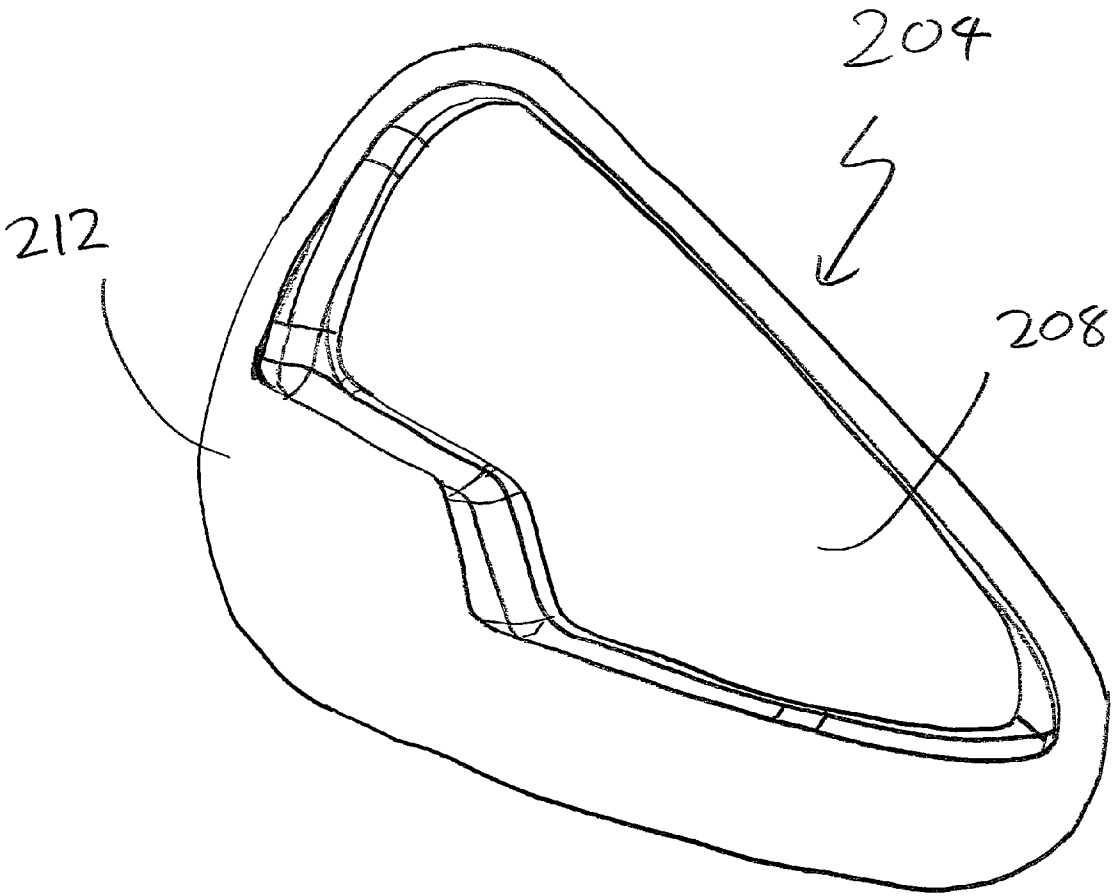
FIG. 2 of the accompanying drawings shows a perspective view of a back portion of a golf club head in accordance with an embodiment of the present invention.

Before moving on to FIG. 2, it is worth noting here that the frontal portion 102 and its rearward facing first cavity 106 creates a frontal flange 110, while the back portion 104 and its frontal facing second cavity 108 creates a back flange 112. The back flange 112, as defined in the present invention, may generally be a substantially planer surface that separates the frontal portion 102 from the back portion 104. The frontal flange 110 and the back flange 112 mate with one another to create a unitary golf club head 100 via a welding process after the individual components are forged. Although welding is the most preferred method of joining the frontal portion 102 and the back portion 104, various other alternative joining methods such as swaging, gluing, or even mechanical locks can all be used without departing from the scope and content of the present invention. The frontal flange 110, in the current exemplary embodiment, may generally have a surface area of less than about 650 $mm^2$, more preferably less than about 625 $mm^2$, and most preferably less than about 600 $mm^2$. The back flange 112, on the other hand has a surface area of greater than about 1400 $mm^2$, more preferably greater than about 1450 $mm^2$, and most preferably greater than about 1500 $mm^2$.

In the current exemplary embodiment, the creation of the undercut can also be quantified by the difference in area between the frontal flange 110 and the back flange 112. In fact, the creation of an undercut is generally a result of the area of the back flange 112 being bigger than the area of the frontal flange 110. Alternatively speaking the bigger the difference in the surface area between the frontal flange 110 and the back flange 112, the greater the undercut; as quantified by an Undercut Surface Area Ratio. The Undercut Surface Area Ratio, as referred to by the current specification, may generally be defined as an area of the back flange 112 divided by the area of the frontal flange 110 as illustrated in Equation (2) below:

$$\text{Undercut Surface Area Ratio} = \frac{\text{Area of back flange 112}}{\text{Area of frontal flange 110}} \quad \text{Eq. (2)}$$

In the present invention, the Undercut Surface Area Ratio may generally be greater than 1, symbolizing that the area of the back flange 112 is greater than the area of the frontal flange 110. However, based on the surface area described above, the Undercut Surface Area Ratio could even be greater than about 2.0, greater than about 2.25, or greater than about 2.5; all without departing from the scope and content of the present invention.

FIG. 2 of the accompanying drawings shows a perspective view of the back portion 204 allowing the back flange 212 and the second cavity 208 to be shown more clearly. In addition to the above, FIG. 2 of the accompanying drawings also illustrates that substantially planer nature of the back flange 212, which serve to combine with the frontal flange 110 (shown in FIG. 1) to create the overall golf club head 100 (shown in FIG. 1).

Although the preferred embodiment may generally utilize a back portion 204 that is forged out of steel, the back portion 204 can be created out of a casting process or any other forming process without departing from the scope and content of the present invention. When a golf club head is bisected as it was in FIG. 1, a majority of the strength, sound, and feel are derived from the frontal portion 102 (see FIG. 1), hence it is crucial that the frontal portion 102 has to be forged. However, if so desired, the back portion 204 may be casted to complete the golf club head without departing from the scope and content of the present invention.

Figure 3:
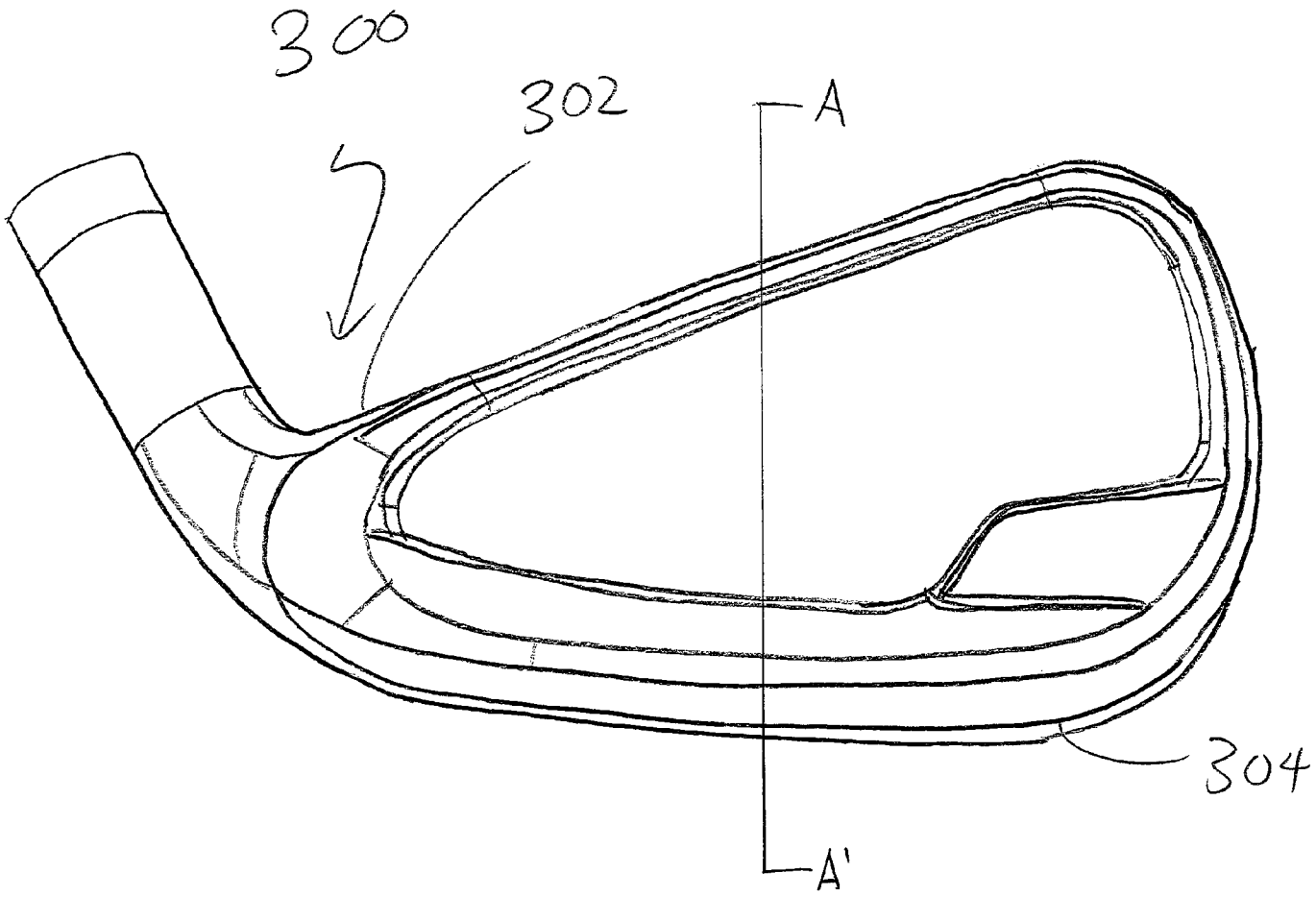
FIG. 3 of the accompanying drawings shows a back view of a golf club head in accordance with an embodiment of the present invention illustrating cross-sectional line A-A'.

FIG. 3 of the accompanying drawings shows a back view of an assembled golf club head 300 in accordance with an exemplary embodiment of the present invention. In or to create the assembled golf club head 300 the frontal portion 302 is welded to the back portion 304 around the outer perimeter of the interface between the frontal portion 302 and the back portion 304. Alternatively speaking, it can be said that the frontal portion 302 is welded to the back portion 304 via the perimeter of the frontal flange and the back flange contact areas that encircles these perimeters in a 360° orientation. Finally, in addition to the above, FIG. 3 also shows cross-sectional line A-A', from which subsequent figures will use to provide cross-sectional views of golf club head 300. Cross-sectional line A-A' as defined by the current invention, bisect the golf club head near the middle of the golf club head 300 at the center of the scorelines (not shown) to provide a convenient illustration of the internal relationships between the components.

Figure 4:
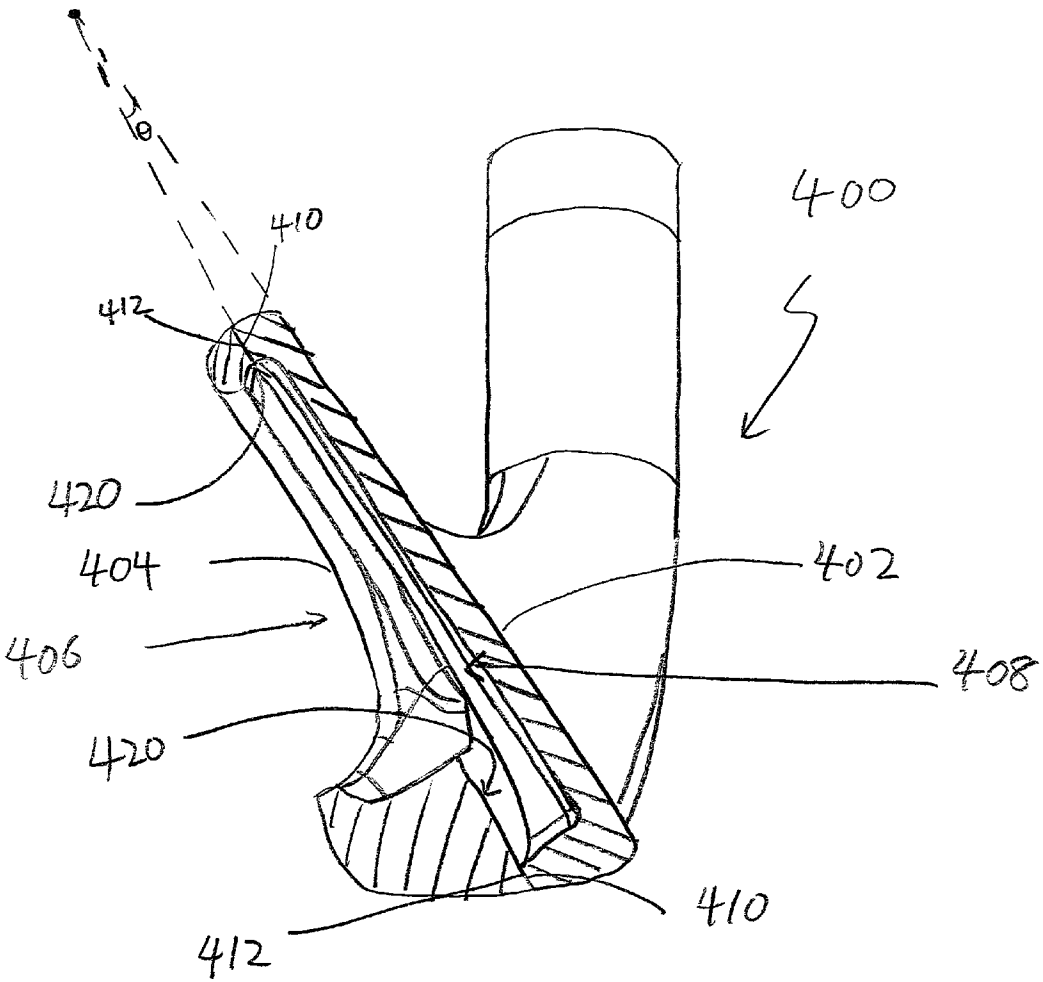
FIG. 4 of the accompanying drawings shows a cross-sectional view of a golf club head in accordance with an embodiment of the present invention taken along cross-sectional line A-A'.

FIG. 4 of the accompanying drawings shows a cross-sectional view of a golf club head 400 taken across cross-sectional line A-A' as shown in FIG. 3. The cross-sectional view of the golf club head 400 shown in FIG. 4 not only shows how the individual components such as the frontal portion 402 and the back portion 404 mate, but also shows the existence of the undercut 420 at both the top and bottom portion of the golf club head 400. An undercut 420, as defined in the present invention, may generally relate to a cutout that exists underneath and around the cavity portion of a cavity back type golf club head 400. The undercut 420, as previously discussed, removes weight from undesirable and unnecessary portions of the golf club head 400 to yield performance improvements such as an increase in the moment of inertia as well as the creation of more discretionary weight to improve center of gravity location. Hence, it can be said that the golf club head 400 comprises an undercut around the joint of the frontal portion 402 and the back portion 404. An alternate way to define the undercut 420 is by the comparison of the size of the cavities. More specifically, in situations where the first cavity 406 is smaller than the second cavity 408, it can be said that an undercut 420 exists.

FIG. 4 of the accompanying drawings also shows that the interface of the frontal flange 410 and the back flange 412 being offset from the striking surface of the golf club head 400. More specifically, the interface of the frontal flange 410 and the back flange 412 may be at an angle that is offset at an angle θ from the loft angle of the golf club head 400. The angle θ as shown in the current exemplary embodiment may generally be between about 5° and about 9°, more preferably between about 6° and about 8°, and most preferably about 7° without departing from the scope and content of the present invention.

Figure 5:
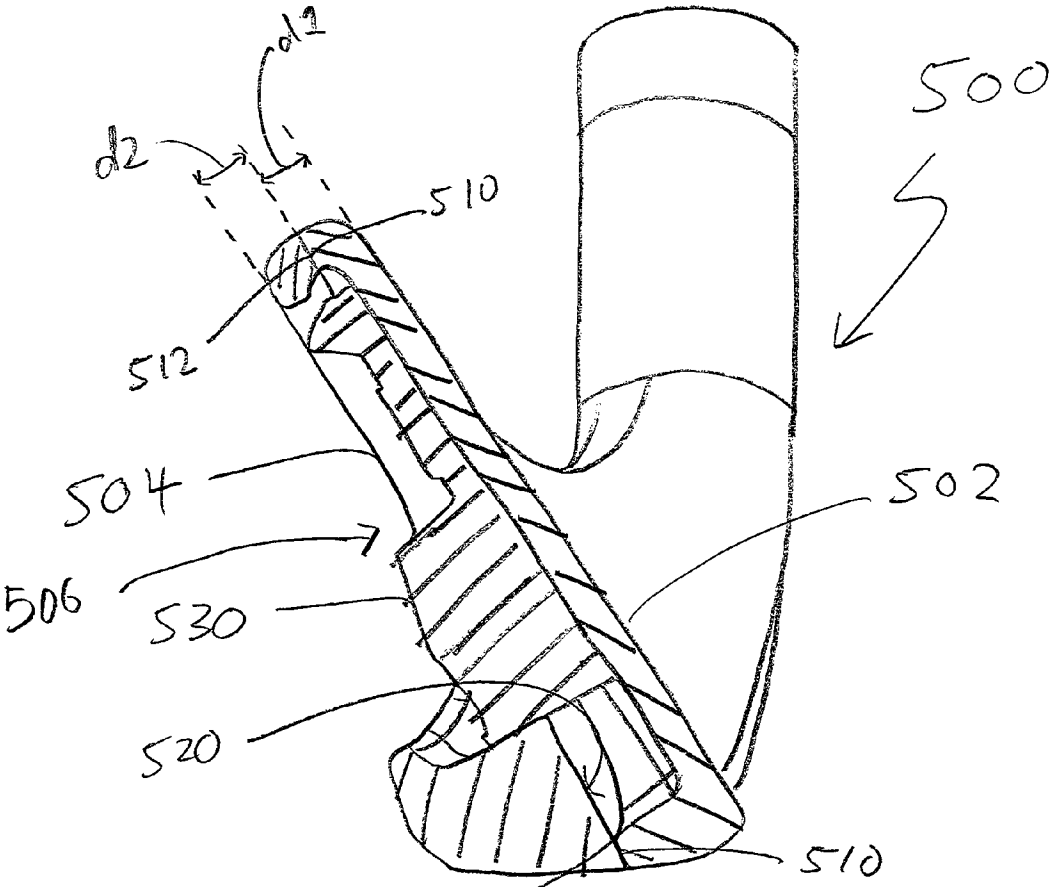
FIG. 5 of the accompanying drawings shows a cross-sectional view of a golf club head in accordance with an alternative embodiment of the present invention taken along cross-sectional line A-A'.

FIG. 5 of the accompanying drawings shows a cross-sectional view of a golf club head 500 in accordance with an alternative embodiment of the present invention taken along cross-sectional line A-A' shown in FIG. 3. First off, it can be seen that in this embodiment of the present invention, the golf club head may contain a medallion 530 placed within the second cavity 506. The usage of a medallion 530 may generally help enhance the aesthetic appeal of the golf club head 500 by providing a visually appealing cosmetic design to a golf club head 500. In addition to enhancing the aesthetic appeal, the medallion 530 may also provide some vibration dampening to further help with the sound and feel of the golf club head 500 as well.

In addition to showing the medallion 530, FIG. 5 of the accompanying drawings also shows a thickness of the topline of the golf club head as it is bisected by the plane created by the frontal flange 510 and the back flange 512. The topline thicknesses of the different portions are defined by the bisection plane. In the present embodiment, the frontal portion 502 may have a first topline thickness d1 of about 3.4 mm while the back portion 504 may have a second topline thickness d2 of about 3.0 mm. This relative thickness of the topline illustrates how thin the toplines can be in the present invention, and care must be used to forging the necessary components. In the present invention, the first topline thickness d1 may generally be slightly greater than the second topline thickness d2, resulting in a more solid feel of the golf club head 500 without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the aforementioned specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. An iron type golf club head comprising:

a forged frontal portion having a first cavity and a substantially planar frontal flange; and a back portion having a second cavity and a substantially planar back flange, wherein said frontal portion and said back portion are joined together at an interface between said frontal flange and said back flange portions to form said iron type golf club head, wherein said iron type golf club head comprises an undercut around said interface, and wherein said planar frontal flange and said back flange combine to yield an Undercut Surface Area Ratio of greater than 2;

said Undercut Surface Area Ratio is defined as an area of said back flange divided by an area of said frontal flange.

2. The iron type golf club head of claim 1, wherein said forged frontal portion is forged out of a singular piece of steel.

3. The iron type golf club head of claim 2, wherein said back portion is forged out of a singular piece of steel.

4. The iron type golf club head of claim 2, wherein said back portion is formed by a casting method.

5. The iron type golf club head of claim 1, wherein a surface area of said back flange is greater than a surface area of said frontal flange to create an undercut.

6. The iron type golf club head of claim 1, wherein said second cavity is smaller than said first cavity.

7. The iron type golf club head of claim 1, wherein said forged frontal portion further comprises; a striking face, a hosel, and a portion of a topline.

8. The iron type golf club head of claim 1, wherein said Undercut Surface Area ratio is greater than about 2.25.

9. The iron type golf club head of claim 8, wherein said portion of said topline of said frontal portion has a thickness of about 3.4 mm.

10. The iron type golf club head of claim 9, wherein said portion of said topline of said back portion has a thickness of about 3.0 mm.

11. An iron type golf club head comprising:

a forged frontal portion having a first cavity and a substantially planar frontal flange; and a back portion having a second cavity and a substantially planar back flange, wherein said frontal portion and said back portion are joined together at an interface between said frontal flange and said back flange portions to form said iron type golf club head, and wherein said forged frontal portion has a mass of between about 115 grams to about 125 grams, wherein said back portion has a mass of between about 70 grams to about 90 grams, and wherein said forged frontal portion and said back portion combine to create an undercut wherein said frontal flange has a surface area of less than about 650 $mm^2$ and said back flange has a surface area of greater than about 1400 $mm^2$.

12. The iron type golf club head of claim 11, wherein said planar frontal flange and said planar back flange combine to yield an Undercut Surface Area Ratio of greater than 1;

said Undercut Surface Area Ratio is defined as an area of said back flange divided by an area of said frontal flange.

13. The iron type golf club head of claim 11, wherein said forged frontal portion further comprises; a striking face, a hosel, and a portion of a topline.

14. An iron type golf club head comprising:

a forged frontal portion having a first cavity and a substantially planar frontal flange; and a back portion having a second cavity and a substantially planar back flange, wherein said frontal portion and said back portion are joined together at an interface between said frontal flange and said back flange portions to form said iron type golf club head, and wherein said forged frontal portion and said back portion combine to create an undercut, and wherein said planar frontal flange and said planar combine to yield an Undercut Surface Area Ratio of greater than 2;

said Undercut Surface Area Ratio is defined as an area of said back flange divided by an area of said frontal flange.

15. The iron type golf club head of claim 14, wherein said frontal flange has a surface area of less than about 650 $mm^2$ and said back flange has a surface area of greater than about 1400 $mm^2$.

* * * * *